US006063001A

United States Patent [19]

Sühling et al.

[11] Patent Number: 6,063,001

[45] Date of Patent: May 16, 2000

[54] GEARBOX ASSEMBLY FOR DEEP OIL WELL PUMPS

[75] Inventors: Richard G. Sühling, Raesfeld; Hans K. Wefers, Jever, both of Germany

[73] Assignee: Franz Morat KG (GmbH & Co.), Eisenbach/Hochschwarzwald, Germany

[21] Appl. No.: 09/061,350

[22] Filed: Apr. 16, 1998

[30] Foreign Application Priority Data

Sep. 16, 1997 [DE] Germany ..... 197 15 278

[51] Int. Cl.[7] ..... F04B 17/00

[52] U.S. Cl. ..... 475/331; 475/159; 417/410.3; 417/424.2; 74/467

[58] Field of Search ..... 475/159, 337, 475/331; 417/410.3, 424.1, 424.2; 74/467

[56] References Cited

U.S. PATENT DOCUMENTS

| | | | |
|---|---|---|---|
| 3,667,665 | 6/1972 | Corkill | 417/410.3 |
| 4,417,860 | 11/1983 | Justice | 417/415 |
| 4,669,961 | 6/1987 | Lorett | 417/410.3 X |
| 5,573,063 | 11/1996 | Morrow | 475/207 X |

*Primary Examiner*—Charles A. Marmor
*Assistant Examiner*—Ankur Parekh
*Attorney, Agent, or Firm*—William J. Daley, Jr.

[57] ABSTRACT

Featured is a gearbox that is used to interconnect an electric motor to a deep oil well tube pump such as an eccentric worm pump. The gearbox includes a drive shaft mechanically interconnected to the pump, a reduction gear assembly mechanically interconnected to the drive shaft and the electric motor, a bearing system that axially and radially supports rotating members of the reduction gear assembly, a lubrication system and a compensator that is fluidly coupled to the lubrication system. The lubrication system provides a lubricating fluid to the bearing system and the gear reduction assembly for lubrication and cooling. The compensator includes a reservoir of cooled lubricating fluid for the lubrication system and also provides pressure compensation between the pressure external to the gearbox and the lubrication system and the internal pressure of the lubrication system. The reduction gear assembly includes one or more stages of planetary gearing, wherein one stage of gearing, the final planet stage, includes three or more planet wheels, a pinion cage and a pinion cage member. The pinion cage member is mechanically interconnected to both the pinion cage and the drive shaft. The three or more planet wheels and the pinion cage are rotatably interconnected so rotation of the planet wheels causes the pinion cage and the pinion cage member to rotate about a common axis. The bearing system includes a bearing sub-assembly for supporting the final planet stage, the bearing sub-assembly including a plurality of axial and radial bearings.

17 Claims, 4 Drawing Sheets

GEARBOX ASSEMBLY FOR DEEP OIL WELL PUMPS

This application claims the benefit of German Patent Application No. 19715278.3-15 the teaching of which are incorporated herein by reference.

FIELD OF INVENTION

The present invention relates to a gearbox or gearbox assembly used with deep oil well pumps and more particularly to a gearbox or gearbox assembly for a deep oil well pump, where the gearbox, motor and pump are all disposed within the drilled hole of the well.

BACKGROUND OF THE INVENTION

In deep oil well production it is necessary to pump the natural oil from within the earth to the surface. In one method, an eccentric worm pump is located in the borehole at the desired depth and the drive and motor are located on the surface. Drives for eccentric worm pumps for the transportation of liquids in the natural oil conveying industry are known, in which a motor drives a pump down in a well by means of deep well pump rods at a speed which is constant, can be switched in phases or infinitely (e.g., electrically, mechanically or hydrostatically controlled) via a step-down gear all of which is positioned above ground. The deep well pump rods, however, are long, heavy, expensive and power-consuming rods. Such drives and the rods also are unsuited for use with deviated wells. Further, such drives cannot be adapted for use at the bottom of the well or in the borehole due to their large dimensions.

Attempts have been made to develop a gearbox assembly that can be co-located in the borehole along with the pump and motor. However, these gearboxes were unable to sustain operational capability for long periods of time under the severe environmental conditions, high temperatures on the order of 120–130° C. (250–270° F.) and high pressures on the order of 40–50 atmospheres. Such gearbox assemblies also proved to be very complex and employed multiple lubrication systems.

It thus would be desirable to provide a gearbox that can resist the environmental conditions that exist with deep oil wells, that would develop high torque and which would be small in cross section so it could be located with the pump and motor in the well borehole. It would be particularly desirable to provide such a gearbox that would be capable of withstanding the high axial loads developed by the head of pumped oil. It also would be desirable to provide such a gearbox that would operate for long time periods and include an improved lubrication system that would ensure adequate lubrication and cooling of rotating and bearing components of the gearbox when located in a borehole in comparison to prior art devices.

SUMMARY OF THE INVENTION

The present invention features a gearbox that is used to interconnect an electric motor to a deep oil well tube pump such as an eccentric worm pump. The gearbox of the present invention creates a relatively maintenance-free gear unit that permits large torques, tolerates large axial forces on the drive shaft and is built so small that it can be used in a very deep well without problems as experienced by prior art units. Also, such a gearbox can withstand the environmental conditions in oil wells at depths of 800–1500 meters while achieving a high service life, on the order of a year, in comparison to prior art gearboxes.

In one aspect of the present invention, the gearbox includes a drive shaft that is mechanically interconnected to a pump, a reduction gear assembly that is mechanically interconnected to the drive shaft and an electric drive motor, a bearing system that axially and radially supports rotating members of the reduction gear assembly, a lubrication system and a compensator that is fluidly coupled to the lubrication system.

The lubrication system provides a lubricating fluid to the bearing system and the gear reduction assembly for lubrication and cooling. The compensator includes a reservoir of cooled lubricating fluid for the lubrication system. The compensator also provides pressure compensation between the pressure external to the gearbox and the lubrication system and the internal pressure of the lubrication system. In this way, volumetric expansion or contraction of the fluid comprising the lubrication system is accommodated. This minimizes the potential for fluid leakage from the lubrication system or rupture of the lubrication system pressure boundary during a volumetric expansion or an influx of contaminants during a volumetric contraction. Additionally, the compensator functions as a heat exchanger so as to cool the lubricating fluid in the reservoir.

In a specific embodiment, the lubricating system further includes a channel system fluidly coupled to the compensator and the reservoir thereof and a pump spindle that is fluidly coupled to the channel system. The pump spindle also is mechanically interconnected to a portion of the reduction gear assembly so the pump spindle is rotated thereby. The rotation of the pump spindle causes the lubricating fluid to flow through the channel system and the compensator thereby lubricating and cooling the bearing system and the gear reduction assembly.

In another aspect of the invention, the reduction gear assembly includes one or more stages of planetary gearing, wherein one stage of gearing, the final planet stage, includes three or more planet wheels, a pinion cage and a pinion cage member. The pinion cage member is mechanically interconnected to both of the pinion cage and the drive shaft. The three or more planet wheels and the pinion cage are rotatably interconnected so rotation of the planet wheels causes the pinion cage and the pinion cage member to rotate about a common axis.

In specific embodiment, the reduction gear assembly further comprises two stages of planetary gearing, a first planet stage and the final planet stage, where the final planet stage further includes five planet wheels and a sun wheel that rotatably engages each of the five planet wheels. In this way, rotation of the final planet stage sun wheel causes the planet wheels to rotate thereabout and thus cause the pinion cage and pinion cage member to rotate about the common axis responsive to the rotation of the final planet stage sun wheel.

The first planet stage includes a stationary pinion cage; three or more planet wheels, more particularly three planet wheels, that are each rotatably secured to the stationary pinion cage and a hollow wheel. The hollow wheel is disposed about the three or more planet wheels and is mechanically interconnected to each of the planet wheels so rotation of the planet wheels causes the hollow wheel in turn to rotate. In this way, the first planet stage sun wheel, which is mechanically interconnected to the drive motor and the three or more planet wheels, causes the hollow wheel to rotate. Also, the first planet stage hollow wheel supports the final planet stage sun wheel so rotation of the first stage hollow wheel causes the final planet stage sun wheel to rotate.

In a more specific embodiment, the gearbox further comprises a housing in which is disposed the reduction gear assembly, the bearing system, the compensator and the lubricating system. The housing also includes an internal tooth system cut into the housing and disposed so as to engage teeth of each of the planet wheels of the final planet stage. In this way, each of the planet wheels of the final planet stage rotate about the final planet stage sun wheel.

Making use of the entire construction area available in the final planet phase (diameter) is a great advantage, meaning that a maximum driven end torque can be achieved with the best possible service life by optimizing the gear-tooth system of this phase and a favorable selection of the number of planet pinions. A further advantage is also to be seen in the existence of pressure compensation between the oil space and the outer wall of the gear.

In another aspect of the invention, the bearing system includes a bearing sub-assembly for supporting the final planet stage, the bearing sub-assembly including a plurality of axial and radial bearings. More specifically, the bearing sub-assembly includes a radial bearing, a spring-loaded small axial bearing and one or more thrust roller bearings such as one or more tapered roller bearings or axial cylinder roller bearings. The radial bearing and spring loaded axial bearing are disposed about and on one side of the final planet stage pinion cage member and provide axial and radial support for the final planet stage pinion cage member. The one or more thrust roller bearings are disposed about and on one side of the final planet stage pinion cage and provide axial and radial support for the final planet stage pinion cage. In specific embodiments, the one or more thrust roller bearings are preloaded by the spring-loaded small axial bearing so as to avoid lifting of the tapered or axial cylinder roller bearings. Also, the one or more tapered or axial cylinder roller bearings can be arranged in one of a tandem or a multiple bearing arrangement about and to one side of the final planet stage pinion cage.

Other aspects and embodiments of the invention are discussed below.

BRIEF DESCRIPTION OF THE DRAWING

For a fuller understanding of the nature and desired objects of the present invention, reference is made to the following detailed description taken in conjunction with the accompanying drawing figures wherein like reference character denote corresponding parts throughout the several views and wherein.

DESCRIPTION OF THE PREFERRED EMBODIMENT

Figure 1:
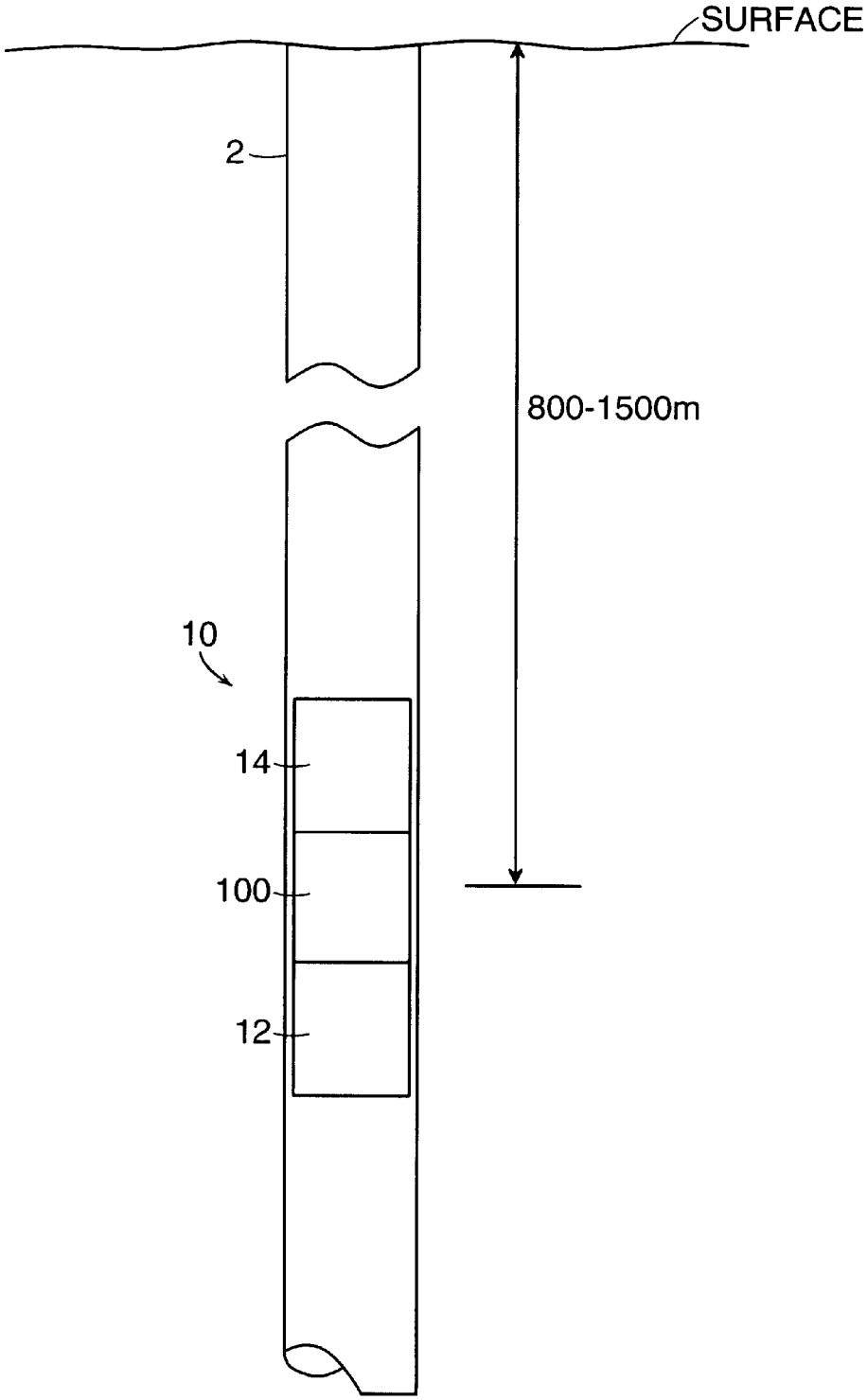
FIG. 1 is a schematic view of a deep oil well pump assembly including a gearbox according to the present invention.

Referring now to the various figures of the drawing wherein like reference characters refer to like parts, there is shown in FIG. 1 a schematic view of a deep oil well pump assembly 10 including a motor 12, an eccentric worm pump 14 and a gearbox 100 according to the present invention. This pump assembly 10 is lowered as a unit into a borehole 2 that is approximately 120 millimeters (approx. 4.75 in.) in diameter. The pump assembly 10 is typically lowered in the borehole 2 to a depth of approximately 800–1500 meters (about 2600–5000 ft.) to bring the natural oil to the surface over a pressure pipe (not shown).

Figure 2A:
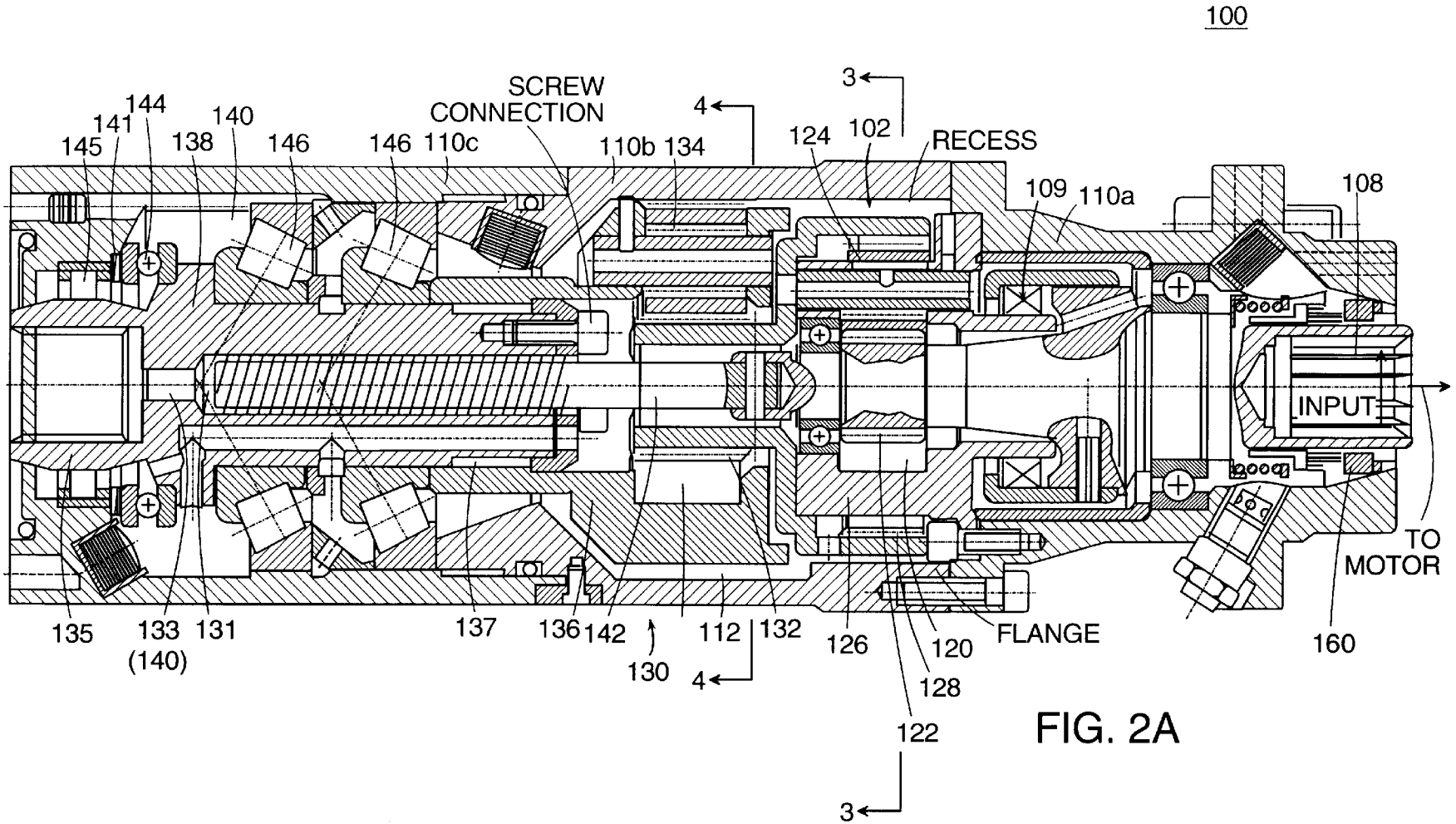
FIG. 2A is a cross-sectional side view of the portion of the gearbox according to the present invention including the step down gear assembly.
Figure 2B:
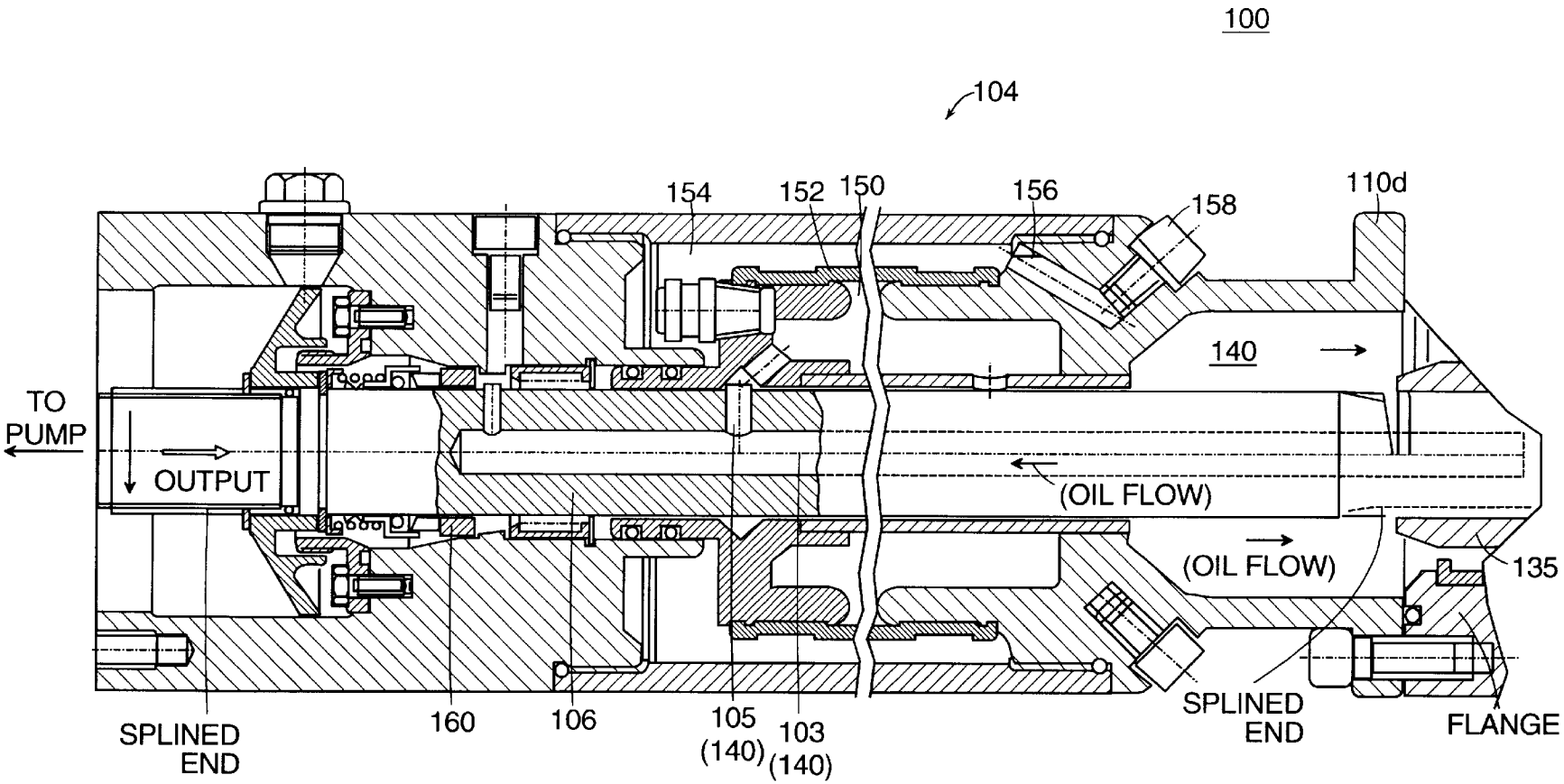
FIG. 2B is a cross-sectional side view of the portion of the gearbox according to the present invention including the compensator.
Figure 3:
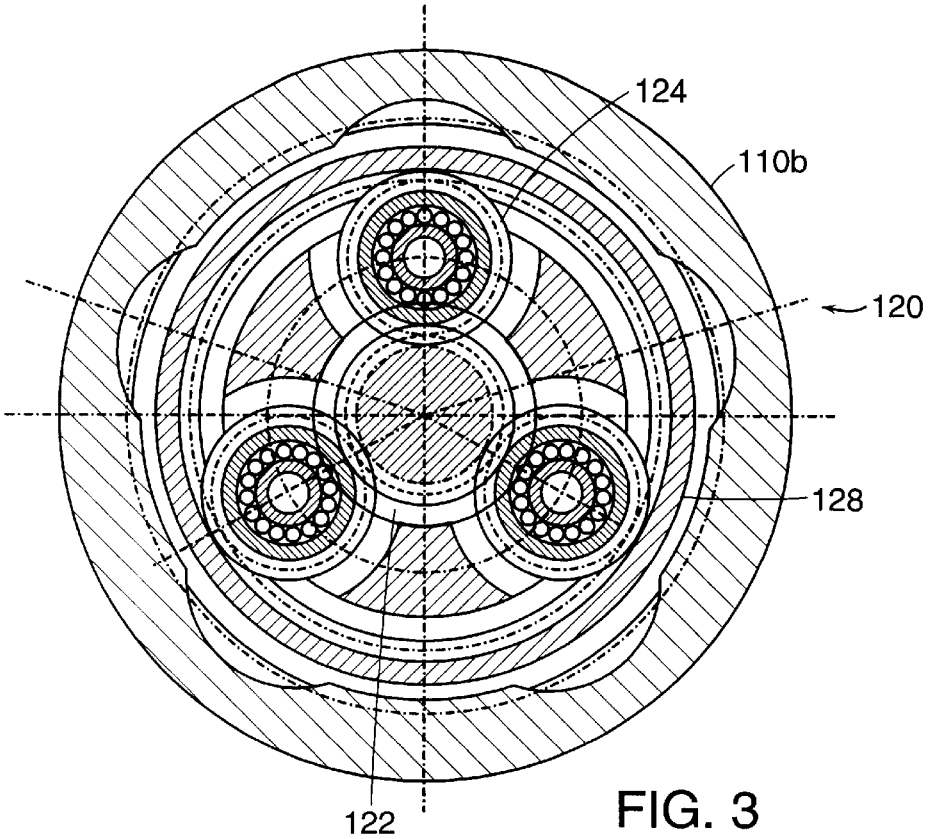
FIG. 3 is a cross-sectional view of the step down gear assembly along the section line 3—3 of FIG. 2A.
Figure 4:
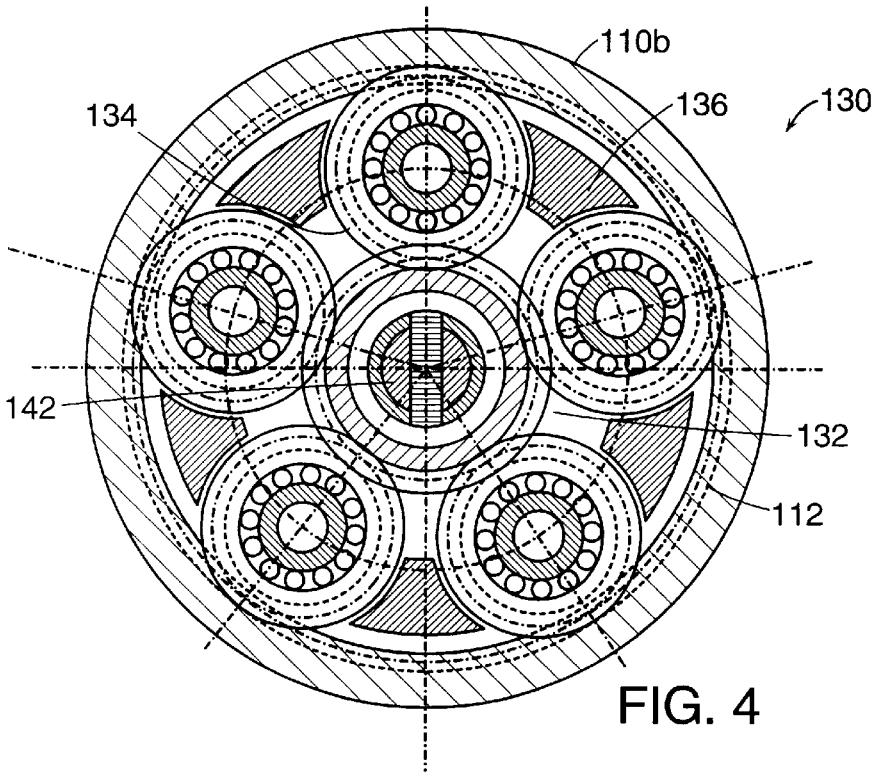
FIG. 4 is a cross-sectional view of the step down gear assembly along the section line 4—4 of FIG. 2A.

There is shown in FIGS. 2A,B a cross-sectional side view of a gearbox 100 according to the present invention, where the portion of the gearbox containing the step down gear assembly 102 is shown on FIG. 2A and the portion containing the compensator 104 is shown on FIG. 2B. Additionally, section views along lines 3—3 and 4—4 of FIG. 2A are shown, respectively, in FIGS. 3 and 4. More particularly, the gearbox 100 of the present invention includes a four part housing 110*a–d*, a step down gear assembly 102, a compensator 104, a drive shaft 106, an input hub 108 and a lubrication sub-system that is described in more detail below. The drive shaft 106 is mechanically interconnected to the pump 14 and step down gear assembly 102 and the input hub 108 is mechanically interconnected to the electrical motor 12. In an exemplary embodiment, the electrical motor is a frequency-controlled two-pole electrical motor as is known to those skilled in the art.

The step down gear assembly 102 includes one or more stages of planetary gearing and a bearing sub-system that rotatably and axially supports certain rotating components of the step down gear assembly. In an illustrative embodiment, the step down gear assembly 102 includes two stages or phases of planetary gearing, a first stage 120 and a second or final stage 130.

The first stage 120 of planetary gearing includes a sun wheel 122 mechanically interconnected to the input hub 108, three or more planet wheels 124, a stationary pinion cage 126 and a hollow wheel 128. The first stage sun wheel 122 is mechanically interconnected to the input hub 108 so rotation of the electric drive motor's output shaft in turn causes the first stage to rotate. This interconnection can further include a clutching mechanism 109 so as to protect the pump from rotation in the wrong direction.

Each of the first stage planet wheels 124 are rotatably mounted onto a hollow shaft secured to the stationary pinion cage 126 pinion cage and disposed about the first stage sun wheel 122 so the teeth of the wheels and the teeth of the sun wheel are meshed. In a specific embodiment, the first stage is configured to have three planet wheels 124 disposed about the sun wheel 122. The central bore through the hollow shaft also forms one of the plurality of flowpaths or channels provided in the gearbox 100 to direct and channel the flow of lubricating fluid throughout the gearbox.

The hollow wheel 128 is disposed about the planet wheels 124 so the teeth of the wheels mesh with the teeth on an inner surface of the hollow wheel. Because the planet wheels 124 are rotatably secured to the stationary pinion cage 126, the rotation of the planet wheels cause the hollow wheel 128 to rotate about the sun wheel 122 in an opposite direction with respect to the sun wheel.

The final stage 130 of planetary gearing includes a sun wheel 132, a plurality of planet wheels 134, a rotating pinion cage 136 and a pinion cage member 138. More particularly, the final stage 130 includes three or more planet wheels 134 and in a specific embodiment five planet wheels. The planet wheels 132 are rotatably secured to the pinion cage 136 and are disposed about the sun wheel 132 so the teeth of the sun wheel mesh with and engage the teeth of the each planet wheel 134.

Additionally, a portion of the interior surface of the second housing part 110*b* is configured with toothing 112, where the planet wheels 134 of the final stage also are disposed so the inner housing toothing 112 meshes and engages the teeth of each planet wheel.

The final stage sun wheel 132 is mechanically and firmly connected to the first stage hollow wheel 128 so the rotation of the first stage hollow wheel in turn causes the final stage sun wheel to rotate. The rotation of the final stage sun wheel 132 in turns causes each of the planet wheels 134 to rotate and thus rotatably drive the final stage pinion cage 136.

The final stage pinion cage member 138 is firmly and mechanically connected to the final stage pinion cage 136 by means of a splined connection 137 and a screw connection. Thus, the final stage pinion cage member 138 rotates along with the rotation of the final stage pinion cage 136. The pinion cage member 138 also includes an end connection 135 that is configured to mate with one end of the drive shaft 106. In a particular embodiment, the drive shaft and end connection are configured with a splined connection tooth system.

As indicated above the pinion cage member and pinion cage are axially and radially supported by means of a bearing sub-assembly. As shown in FIG. 2A, the bearing sub-assembly includes a radial bearing 145, an axial bearing 144 and one or more thrust roller bearings 146, more particularly one or more tapered roller bearings or axial cylinder roller bearings. These bearings are disposed about the pinion cage member and on one side thereof. The radial bearing 145 is any of a number of radial bearings known in the art including, for example, a cylindrical roller bearing.

The final stage pinion cage member 138 is axially loaded by the pump during operation, so the one or more thrust roller bearings 146 are free from play. In order to avoid a lifting of these one or more thrust roller bearings 146, the axial bearing 144 preferably is a spring-loaded small axial bearing including a spring 141 so as to pre-load the one or more thrust roller bearings. In a particular embodiment, the axial bearing 144 is a deep groove ball thrust bearing. Also, the one or more thrust roller bearings 146 can be configured, as shown in FIG. 2A, so there is a tandem bearing arrangement. Alternatively, a multiple bearing arrangement can be employed.

As indicated above, the gearbox 100 of the present invention includes a lubrication sub-system that circulates a lubricating fluid throughout the gearbox to lubricate and cool the bearings and rotating components of the step down gear assembly 102. The lubricating subsystem includes a channel system 140 that is fluidly coupled to the compensator 104, and a pump spindle 142.

As shown in FIG. 2A, the final stage pinion cage member 138 includes a central bore 131 for receiving the pump spindle 142 of the lubricating system and an end passage 133 that forms another channel for the flow of lubricating fluid. With the pump spindle 142 disposed in the central bore 131 of the final stage pinion cage member 138, the pump spindle can function as an oil pump to continuously circulate the lubricating fluid or gear oil through the channel system 140. Additionally, the pump spindle 142 is in torsion-resistant connection with the first stage sun wheel 122 so the pump spindle is rotated thereby.

The threaded or spindle pump 142 is fluidly coupled to the compensator 104 by means of a central bore 103 and a radial through port 105 in the drive shaft 106 which also forms a part of the channel system 140. Thus, the lubricating fluid exiting the spindle pump 142 passes through the end passage 133 into the drive shaft central bore 103 and thence out of the shafts' radial port 105 into the reservoir 150 of the compensator 104. Additionally the internal structure of the compensator 104 is configured with a groove about the drive shaft 106, proximate the radial through port 105, so the port remains fluidly coupled with the reservoir 150.

The compensator 104 has the task of bringing about a balance of pressure between the external pressure and the internal pressure in the gearbox 100. The gearbox 100 is sealed to the outside by 2 slide ring seals 160 in the two end housing parts 110*a,d* and is totally filled with oil, including the reservoir 150 of the compensator. The balance of pressure is done via a flexible membrane 152, illustrated as being interrupted (not at its full length) in FIG. 2B. In an exemplary embodiment, the flexible membrane 152 is preferably of Viton (DuPont), however, the flexible membrane can be any other material suitable for the pressure, temperature and other environmental conditions of the intended service.

One side of the flexible membrane 152 is exposed to the lubricating fluid in the reservoir 150 and the other side of the membrane is exposed to the fluid, the natural oil, located in a chamber 154 in fluid communication with the exterior via a bore 156. The flexible membrane 152 provides a mechanism by which volumetric expansion and contraction of the lubricating fluid because of differences between the internal and external pressure can be accommodated without causing the pressure boundary of the lubricating sub-system to be violated. In this way, contaminates cannot gain entry into the lubricating sub-system. The illustrated locking screw 158 is provided for the function test in the filling of lubricant and is removed during operation of the gearbox 100.

In addition, because the channel system 140 fluidly couples the lubricating sub-system to the reservoir 150 of the compensator 104 the circulating action of the spindle pump 142 integrates the oil in the reservoir into the cooling and lubrication circulation of the channel system 140. Thus, the large surface area of the compensator 104, in particular the flexible membrane 152 additionally acts to remove the heat from the lubricating fluid and disperse it to the external natural oil. The large amount of lubricating fluid and the good circulation, together with the cooling of all parts of the gearbox and bearing, increases the service life of the gearbox of the present invention as compared to prior art devices.

The main drive shaft 106 includes a splined end connection tooth system at either end of the drive shaft. One end of the drive shaft 106, as provided above is received in the end connection of the final stage pinion cage member and the other end connects to an eccentric worm pump. In this way, the driven end of the step down gear assembly 102 is interconnected to the pump.

Although a preferred embodiment of the invention has been described using specific terms, such description is for illustrative purposes only, and it is to be understood that changes and variations may be made without departing from the spirit or scope of the following claims.

What is claimed is:

1. A gearbox unit that mechanically interconnects a drive motor to a deep oil well tube pump, the gearbox unit comprising:

a drive shaft mechanically interconnected to the pump;

a reduction gear assembly mechanically interconnected to the drive shaft and to the drive motor;

a bearing system that axially and radially supports rotating members of the reduction gear assembly;

a lubrication system that provides a fluid at an internal pressure to the bearing system and the gear reduction assembly for lubrication and cooling;

a compensator in fluid communication with the lubrication system, the compensator including a reservoir of cooled lubricating fluid for the lubricating system and providing pressure compensation between pressure external to the lubricating system and the internal pressure of the lubricating system; and wherein the lubricating system includes:

a channel system fluidly coupled to the compensator;

a pump spindle being mechanically interconnected to a portion of the reduction gear assembly to rotate the pump spindle and being fluidly coupled to the channel system; and wherein rotation of the pump spindle causes the lubricating fluid to flow through the channel system and the compensator thereby lubricating and cooling the bearing system and the gear reduction assembly.

2. A gearbox unit that mechanically interconnects a drive motor to a deep oil well tube pump, the gearbox unit comprising:

a drive shaft mechanically interconnected to the pump;

a reduction gear assembly mechanically interconnected to the drive shaft and to the drive motor;

a bearing system that axially and radially supports rotating members of the reduction gear assembly;

a lubrication system that provides a fluid at an internal pressure to the bearing system and the gear reduction assembly for lubrication and cooling;

a compensator in fluid communication with the lubrication system, the compensator including a reservoir of cooled lubricating fluid for the lubricating system and providing pressure compensation between pressure external to the lubricating system and the internal pressure of the lubricating system; and wherein the reduction gear assembly includes:

one or more stages of planetary gearing;

wherein one stage, the final planet stage, includes three or more planet wheels, a pinion cage and a pinion cage member that is mechanically interconnected to the pinion cage and to the drive shaft;

wherein the three or more planet wheel and the pinion cage are rotatably interconnected so rotation of the planet wheels causes the pinion cage and the pinion cage member to rotate about a common axis; and wherein the bearing system includes a bearing subassembly for supporting the final planet stage, the bearing sub-assembly including a plurality of axial and radial bearings.

3. The gearbox unit of claim 2, wherein the bearing subassembly for the final planet stage further includes a radial bearing;

a spring loaded small axial bearing pre-loading one or more thrust roller bearings;

wherein the radial bearing and spring loaded axial bearing are disposed about and on one side of the final planet stage pinion cage member and provide axial and radial support for the final planet stage pinion cage member; and wherein the one or more thrust roller bearings are disposed about and on one side of the final planet stage pinion cage and provide axial and radial support for the final planet stage pinion cage.

4. The gearbox unit of claim 3, wherein the one or more thrust roller bearings are arranged in one of a tandem or multiple bearings arrangement about and to one side of the final planet stage pinion cage.

5. The gearbox unit of claim 3, wherein the one or more thrust roller bearings includes one or more tapered roller bearings.

6. The gearbox unit of claim 5, wherein the one or more tapered roller bearings are arranged in one of a tandem or multiple bearings arrangement about and to one side of the final planet stage pinion cage.

7. The gearbox unit of claim 3, wherein the one or more thrust roller bearings includes one or more axial cylinder roller bearings.

8. The gearbox unit of claim 7, wherein the one or more axial cylinder roller bearings are arranged in one of a tandem or multiple bearings arrangement about and to one side of the final planet stage pinion cage.

9. The gearbox unit of claim 2, wherein the lubricating system includes:

a channel system fluidly coupled to the compensator;

a pump spindle being mechanically interconnected to a portion of the reduction gear assembly to rotate the pump spindle and being fluidly coupled to the channel system; and wherein rotation of the pump spindle causes the lubricating fluid to flow through the channel system and the compensator thereby lubricating and cooling the bearing system and the gear reduction assembly; and wherein the final planet stage pinion cage member includes a central through bore in which is disposed the pump spindle so the pinion cage member forms a pump housing for the pump spindle and wherein the central bore forms a portion of the channel system.

10. The gearbox unit of claim 9, wherein the reduction gear assembly further includes a first planet stage having a sun wheel, wherein the first planet stage sun wheel is mechanically interconnected to the pump spindle so rotation of the first planet stage sun wheel in turn causes the pump spindle to rotate thereby pumping the lubricating fluid through the channel system.

11. The gearbox unit of claim 2, wherein the reduction gear assembly further comprises two stages of planetary gearing, a first planet stage and the final planet stage:

wherein the final planet stage further includes five planet wheels, and a sun wheel that rotatably engages each of the five planet wheels so rotation of the final planet stage sun wheel causes the planet wheels to rotate thereabout;

wherein the first planet stage includes:

three planet wheels, a stationary pinion cage to which is rotatably secured each of the planet wheels, and a hollow wheel disposed about the three planet wheels and being mechanically interconnected to each of the three planet wheels so rotation of the planet wheels causes the hollow wheel in turn to rotate; and wherein the first planet stage hollow wheel supports the final planet stage sun wheel so rotation of the first stage hollow wheel causes the final planet stage sun wheel to rotate.

12. The gearbox unit of claim 2, further comprising a housing in which is disposed the reduction gear assembly, the bearing system, the compensator and the lubricating system and wherein the housing includes an internal tooth system cut into the housing and being disposed so as to engage teeth of each of the planet wheels of the final planet stage.

13. A gearbox unit that mechanically interconnects a drive motor to a deep oil well tube pump, the gearbox unit comprising a drive shaft mechanically interconnected to the pump;

a reduction gear assembly mechanically interconnected to the drive shaft and to the drive motor, the reduction gear assembly including:

two or more stages of planetary gearing, including a first planet stage and a final planet stage;

wherein the first planet stage includes a sun wheel, and wherein the final planet stage includes three or more planet wheels, a pinion cage and a pinion cage member that is mechanically interconnected to the pinion cage and to the drive shaft, where the three or more planet wheel and the pinion cage are rotatably interconnected so rotation of the planet wheels causes the pinion cage and the pinion cage member to rotate about a common axis;

a bearing system that axially and radially supports rotating members of the reduction gear assembly, the bearing system including a bearing sub-assembly for supporting the final planet stage, the final planet stage bearing sub-assembly including a plurality of axial and radial bearings;

a lubrication system that provides a fluid at an internal pressure to the bearing system and the gear reduction assembly for lubrication and cooling;

a compensator in fluid communication with the lubrication system, the compensator including a reservoir of cooled lubricating fluid for the lubricating system and providing pressure compensation between pressure external to the lubricating system and the internal pressure of the lubricating system; and wherein the lubrication system includes:

a channel system fluidly coupled to the compensator, a pump spindle being mechanically interconnected to the first planet stage sun wheel and being fluidly coupled to the channel system, and wherein rotation of the first planet stage sun wheel causes the pump spindle to rotate thereby pumping the lubricating fluid through the channel system and the compensator thereby lubricating and cooling the bearing system and the gear reduction assembly.

14. The gearbox unit of claim 13, wherein the final planet stage bearing subassembly further includes a radial bearing;

one or more thrust roller bearings a spring loaded small axial bearing pre-loading the one or more thrust roller bearings;

wherein the radial bearing and spring loaded axial bearing are disposed about and on one side of the final planet stage pinion cage member and provide axial and radial support for the final planet stage pinion cage member; and wherein the one or more thrust roller bearings are disposed about and on one side of the final planet stage pinion cage and provide axial and radial support for the final planet stage pinion cage.

15. The gearbox unit of claim 13, wherein the final planet stage pinion cage member includes a central through bore in which is disposed the pump spindle so the pinion cage member forms a pump housing for the pump spindle and wherein the central bore forms a portion of the channel system.

16. The gearbox unit of claim 13, wherein:

the final planet stage further includes:

five planet wheels, and a sun wheel that rotatably engages each of the five planet wheels so rotation of the final planet stage sun wheel causes the planet wheels to rotate thereabout;

the first planet stage further includes:

three planet wheels, a stationary pinion cage to which is rotatably secured each of the planet wheels, and a hollow wheel disposed about the three planet wheels and being mechanically interconnected to each of the three planet wheels so rotation of the planet wheels causes the hollow wheel in turn to rotate; and the first planet stage hollow wheel supports the final planet stage sun wheel so rotation of the first stage hollow wheel causes the final planet stage sun wheel to rotate.

17. The gearbox unit of claim 16, further comprising a housing in which is disposed the reduction gear assembly, the bearing system, the compensator and the lubricating system and wherein the housing includes an internal tooth system cut into the housing and being disposed so as to engage teeth of each of the planet wheels of the final planet stage.

* * * * *